US011299791B2

(12) United States Patent
Lee et al.

(10) Patent No.: US 11,299,791 B2
(45) Date of Patent: Apr. 12, 2022

(54) NON-ORIENTED ELECTRICAL STEEL SHEET AND MANUFACTURING METHOD THEREFOR

(71) Applicant: POSCO, Pohang-si (KR)

(72) Inventors: Hun Ju Lee, Pohang-si (KR); Yong Soo Kim, Pohang-si (KR); Su Yong Sin, Pohang-si (KR)

(73) Assignee: POSCO, Pohang-si (KR)

( * ) Notice: Subject to any disclaimer, the term of this patent is extended or adjusted under 35 U.S.C. 154(b) by 192 days.

(21) Appl. No.: 16/061,183

(22) PCT Filed: Dec. 9, 2016

(86) PCT No.: PCT/KR2016/014473
§ 371 (c)(1),
(2) Date: Jun. 11, 2018

(87) PCT Pub. No.: WO2017/099534
PCT Pub. Date: Jun. 15, 2017

(65) Prior Publication Data

US 2018/0355450 A1 Dec. 13, 2018

(30) Foreign Application Priority Data

Dec. 11, 2015 (KR) ..... 10-2015-0177390

(51) Int. Cl.
*C21D 9/46* (2006.01)
*C21D 8/12* (2006.01)
(Continued)

(52) U.S. Cl.
CPC ..... *C21D 8/1272* (2013.01); *C21D 8/12* (2013.01); *C21D 9/46* (2013.01); *C22C 38/00* (2013.01);
(Continued)

(58) Field of Classification Search
CPC ..... C21D 9/46
See application file for complete search history.

(56) References Cited

U.S. PATENT DOCUMENTS

2005/0000596 A1* 1/2005 Schoen ..... C21D 8/1222 148/111
2011/0273054 A1 11/2011 Johnston
(Continued)

FOREIGN PATENT DOCUMENTS

CN 1520464 A 8/2004
CN 101466851 A 6/2009
(Continued)

OTHER PUBLICATIONS

ASTM International. A683-16 Standard Specification for Nonoriented Electrical Steel, Semiprocessed Types. West Conshohocken, PA; ASTM International, 2016. doi: https://doi.org/10.1520/A0683-16 (Year: 2016).*
(Continued)

*Primary Examiner* — Jophy S. Koshy
(74) *Attorney, Agent, or Firm* — Morgan, Lewis & Bockius LLP

(57) ABSTRACT

A non-oriented electric steel sheet includes 2.5 wt % to 3.1 wt % of Si, 0.1 wt % to 1.3 wt % of Al, 0.2 wt % to 1.5 wt % of Mn, 0.008 wt % or less of C (excluding 0 wt %), 0.005 wt % or less of S (excluding 0 wt %), 0.005 wt % or less of N (excluding 0 wt %), 0.005 wt % or less of Ti (excluding 0 wt %), 0.001 wt % to 0.07 wt % of Mo, 0.001 wt % to 0.07 wt % of P, 0.001 wt % to 0.07 wt % of Sn, and 0.001 wt % to 0.07 wt % of Sb, in which a remainder includes Fe and inevitable impurities, an average crystal grain diameter is 70 μm to 150 μm, the non-oriented electric steel sheet satisfies Equations (1) and (2), $$0.32 \leq ([Al]+[Mn])/[Si] \leq 0.5 \quad \text{[Equation 1]}$$

$$0.025 \leq [Mo]+[P]+[Sn]+[Sb] \leq 0.15 \quad \text{[Equation 2]}$$

(Continued)

(here, a bracket denotes the contents (wt %) of each element).

9 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/00*** | (2006.01) |
| ***C22C 38/60*** | (2006.01) |
| *H01F 1/147* | (2006.01) |

(52) U.S. Cl.
CPC ..... *C22C 38/001* (2013.01); *C22C 38/002* (2013.01); *C22C 38/008* (2013.01); *C22C 38/02* (2013.01); *C22C 38/04* (2013.01); *C22C 38/06* (2013.01); *C22C 38/12* (2013.01); *C22C 38/14* (2013.01); *C22C 38/60* (2013.01); *H01F 1/14775* (2013.01)

(56) References Cited

U.S. PATENT DOCUMENTS

| | | | | |
|---|---|---|---|---|
| 2018/0355450 | A1* | 12/2018 | Lee | C21D 9/46 |
| 2019/0017136 | A1* | 1/2019 | Lee | C22C 38/04 |
| 2020/0087748 | A1* | 3/2020 | Lee | H01F 1/14775 |

FOREIGN PATENT DOCUMENTS

| | | | |
|---|---|---|---|
| CN | 105008568 | A | 10/2015 |
| EP | 1411138 | A1 | 4/2004 |
| EP | 2762591 | A1 | 8/2014 |
| JP | 2001-172753 | A | 6/2001 |
| JP | 2004-084053 | A | 3/2004 |
| JP | 2008-174773 | A | 7/2008 |
| JP | 2011179027 | A | 9/2011 |
| JP | 2012-112015 | A | 6/2012 |
| JP | 2013-010982 | A | 1/2013 |
| JP | 2013-091837 | A | 5/2013 |
| JP | 2014162939 | A | 9/2014 |
| KR | 10-2004-0014960 | A | 2/2004 |
| KR | 10-2009-0014383 | A | 2/2009 |
| KR | 10-2012-0074022 | A | 7/2012 |
| KR | 10-2014-0044929 | A | 4/2014 |
| KR | 10-2014-0058935 | A | 5/2014 |
| KR | 10-2014-0084895 | A | 7/2014 |
| WO | 2003/002777 | A1 | 1/2003 |
| WO | 2007/007423 | A1 | 1/2007 |
| WO | 2007/144964 | A1 | 12/2007 |
| WO | 2015099315 | A1 | 7/2015 |

OTHER PUBLICATIONS

Japanese Decision of Rejection dated Jan. 21, 2020 issued in Japanese Patent Application No. 2018-530579 (with English translation).
Chinese Office Action dated Jun. 28, 2019 issued in Chinese Patent Application No. 201680072525.3.
Written Opinion and International Search Report dated Mar. 6, 2017 issued in International Patent Application No. PCT/KR2016/014473 (with English translation).
Japanese Office Action dated Jul. 23, 2019 issued in Japanese Patent Application No. 2018-530579.

* cited by examiner

NON-ORIENTED ELECTRICAL STEEL SHEET AND MANUFACTURING METHOD THEREFOR

CROSS REFERENCE

This patent application is the U.S. National Phase under 35 U.S.C. § 371 of International Application No. PCT/KR2016/014473, filed on Dec. 9, 2016, which claims the benefit of Korean Patent Application No. 10-2015-0177390, filed on Dec. 11, 2015, the entire contents of each are hereby incorporated by reference.

TECHNICAL FIELD

The present disclosure relates to a non-oriented electrical steel sheet and a method for manufacturing the same.

BACKGROUND ART

A non-oriented electric steel sheet is mainly used for a device configured to convert electric energy into mechanical energy. In this process, excellent magnetic characteristics are required to achieve high efficiency. Examples of the magnetic characteristics include iron loss and a magnetic flux density. Energy lost during an energy conversion process may be reduced when the iron loss is low, and a larger power may be produced using the same electric energy when the magnetic flux density is high. Thus, when the iron loss of the non-oriented electric steel sheet is low and the magnetic flux density of the non-oriented electric steel sheet is high, energy efficiency of a motor may increase. In general, in order to reduce the iron loss of the non-oriented electric steel sheet, an element that increases specific resistance is added or a steel sheet is rolled in a thin thickness.

In general, Si is added as an alloying element to increase the magnetic characteristics of the non-oriented steel sheet. When Si is added to increase resistivity, high-frequency iron loss is lowered, but the magnetic flux density deteriorates and processability is reduced. Thus, when too much Si is added, it is difficult to perform cold rolling. In particular, as the thickness of the electric steel sheet used for high-frequency applications becomes smaller, an iron loss reducing effect may increase. A decrease in the processability, caused by adding Si, causes a serious problem in thin rolling.

In order to overcome the decrease in the processability caused by adding Si, other elements for increasing specific resistance, such as Al and Mn, may be added. Although the iron loss may be reduced through adding these elements, the magnetic flux density deteriorates due to an increase in the total amount of alloy, and it is difficult to perform cold rolling due to an increase in hardness of a material and deterioration of the processability. In addition, Al and Mn are coupled to impurities inevitably existing in the steel sheet, to finely precipitate nitrides, sulfides, or the like, to increase the iron loss. For this reason, in a step of manufacturing the non-oriented electric steel sheet, the impurities are minimized, and thus formation of fine precipitates that hinder movement of a magnetic wall is suppressed, so that the iron loss is lowered. However, in a method of reducing iron loss through highly cleaning a steel, the magnetic flux density is not greatly improved, which is a factor that decreases steelmaking workability and increases costs.

In order to make the non-oriented electric steel sheet into an iron core of a rotating device such as a motor, generally, after the non-oriented electric steel sheet is deformed into objects having a specific shape through a punching process, the objects are stacked. Since a mechanical stress is applied to the steel sheet in the punching process, a residual stress exists near a cut portion after the punching process. The residual stress causes an increase in the iron loss and deterioration of the magnetic flux density. In particular, the residual stress caused by the process greatly affects magnetic characteristics in a low magnetic area where magnetization is mainly caused by the movement of the magnetic wall. To overcome this, deterioration of the magnetic characteristics may be prevented through an additional process such as stress relief annealing after the punching process. However, since costs for the additional process are required and a coating layer of the non-oriented electric steel sheet is deformed due to the additional process, a better solution is required.

DISCLOSURE

Technical Problem

An embodiment of the present disclosure provides a non-oriented electric steel sheet in which deterioration of magnetic characteristics resulting from a punching process is low.

Another embodiment of the present disclosure provides a method of manufacturing a non-oriented electric steel sheet.

Technical Solution

A non-oriented electric steel sheet may include 2.5 wt % to 3.1 wt % of Si, 0.1 wt % to 1.3 wt % of Al, 0.2 wt % to 1.5 wt % of Mn, 0.008 wt % or less of C (excluding 0 wt %), 0.005 wt % or less of S (excluding 0 wt %), 0.005 wt % or less of N (excluding 0 wt %), 0.005 wt % or less of Ti (excluding 0 wt %), 0.001 wt % to 0.07 wt % of Mo, 0.001 wt % to 0.07 wt % of P, 0.001 wt % to 0.07 wt % of Sn, and 0.001 wt % to 0.07 wt % of Sb, in which a remainder includes Fe and inevitable impurities, an average crystal grain diameter is 70 μm to 150 μm, and the non-oriented electric steel sheet satisfies Equations (1) and (2), $$0.32 \leq ([Al]+[Mn])/[Si] \leq 0.5 \quad \text{[Equation 1]}$$

$$0.025 \leq [Mo]+[P]+[Sn]+[Sb] \leq 0.15 \quad \text{[Equation 2]}$$

(Here, in Equations (1) and (2), [Si], [Al], [Mn], [Mo], [P], [Sn], and [Sb] denote the contents (wt %) of Si, Al, Mn, Mo, P, Sn, and Sb.

The thickness of the non-oriented electric steel sheet may be 0.2 mm to 0.65 mm.

Inner cross section hardness may be not more than 210 HV.

(Here, the inner cross section hardness means an average value obtained by 10 times repeatedly measuring Vickers hardness (HV 25 gf) of a portion except for a crystal grain boundary and an inclusion in a cross section of a point apart from a cut portion formed by a punching process by 5 mm or more under a load of 25 gf.)

Cross section hardness of a point apart from the cut portion formed by the punching process by a thickness of the non-oriented electric steel sheet may be not more than 1.1 times of the inner cross section hardness.

A method of manufacturing a non-oriented electric steel sheet according to an embodiment of the present disclosure may include: manufacturing a hot rolled sheet by heating slab including 2.5 wt % to 3.1 wt % of Si, 0.1 wt % to 1.3 wt % of Al, 0.2 wt % to 1.5 wt % of Mn, 0.008 wt % or less of C (excluding 0 wt %), 0.005 wt % or less of S (excluding 0 wt %), 0.005 wt % or less of N (excluding 0 wt %), 0.005 wt % or less of Ti (excluding 0 wt %), 0.001 wt % to 0.07 wt % of Mo, 0.001 wt % to 0.07 wt % of P, 0.001 wt % to 0.07 wt % of Sn, and 0.001 wt % to 0.07 wt % of Sb, in which a remainder includes Fe and inevitable impurities, and then by hot rolling the slab; manufacturing a cold rolled sheet by cold rolling the hot rolled sheet; and recrystallization annealing the cold rolled sheet for 60 seconds to 150 seconds at 875° C. to 1125° C. to have an average crystal grain diameter of 70 μm to 150 μm, in which the slab satisfies Equations (1) and (2), $$0.32 \leq ([Al]+[Mn])/[Si] \leq 0.5 \quad \text{[Equation 1]}$$

$$0.025 \leq [Mo]+[P]+[Sn]+[Sb] \leq 0.15 \quad \text{[Equation 2]}$$

(here, [Si], [Al], [Mn], [Mo], [P], [Sn], and [Sb] denote the contents (wt %) of Si, Al, Mn, Mo, P, Sn, and Sb).

In the manufacturing of the hot rolled sheet, the slab may be heated at 1100° C. to 1200° C.

In the manufacturing of the hot rolled sheet, the hot rolling may be performed at a finish temperature of 800° C. to 1000° C.

The method may further include manufacturing a hot rolled sheet, and annealing the hot rolled sheet at 850° C. to 1150° C.

In the manufacturing of the cold rolled sheet, the cold rolled sheet may be cold rolled in a thickness of 0.20 mm to 0.65 mm.

Inner cross section hardness of the manufactured non-oriented electric steel sheet may be not more than 210 HV.

Cross section hardness of a point apart from a cut portion formed by a punching process by a thickness of the non-oriented electric steel sheet may be not more than 1.1 times of the inner cross section hardness.

Advantageous Effects

In a non-oriented electric steel sheet according to an embodiment of the present disclosure, deterioration of magnetic characteristics caused by a punching process is minimized, so that excellent magnetic characteristics are achieved after the punching process.

MODE FOR INVENTION

Although terms such as first, second, and third are used for describing various parts, various components, various areas, and/or various sections, the present disclosure is not limited thereto. Such terms are used only to distinguish any part, any component, any area, any layer, or any section from the other parts, the other components, the other areas, the other layers, or the other sections. Thus, a first part, a first component, a first area, a first layer, or a first section which is described below may be mentioned as a second part, a second component, a second area, a second layer, or a second section without departing from the scope of the present disclosure.

Here, terminologies used herein are merely used to describe a specific embodiment, and are not intended to limit the present disclosure. A singular form used herein includes a plural form as long as phrases do not express a clearly opposite meaning. The term "include" used in the specification specifies specific characteristics, a specific area, a specific essence, a specific step, a specific operation, a specific element, and/or a specific ingredient, and does not exclude existence or addition of the other characteristics, the other area, the other essence, the other step, the other operation, the other element, and/or the other ingredient.

When it is mentioned that a first component is located "above" or "on" a second component, the first component may be located directly "above" or "on" the second component or a third component may be interposed therebetween. In contrast, when it is mentioned that a first component is located "directly above" a second component, a third component is not interposed therebetween.

Although not otherwise defined, all terms used herein, including technical terms and scientific terms, have the same meanings as those generally understood by those skilled in the art to which the present disclosure pertains. Terms defined in a generally used dictionary are interpreted as meanings according with related technical documents and currently disclosed contents, and are not interpreted as ideal meanings or very formal meanings unless otherwise defined.

Further, unless otherwise defined, % means wt %, and 1 ppm means 0.0001 wt %.

Hereinafter, embodiments of the present disclosure will be described in detail such that those skilled in the art to which the present disclosure pertains may easily implement the embodiments. However, the present disclosure may be implemented in various different forms, and is not limited to embodiments described herein.

Figure 1:
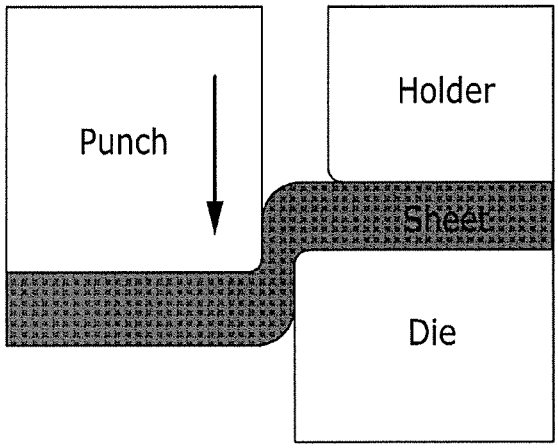
FIG. 1 is a schematic view illustrating a punching process.

In order to make a non-oriented electric steel sheet into an iron core of a rotating motor such as a motor, as illustrated in FIG. 1, after the non-oriented electric steel sheet is deformed into objects having a specific shape through a punching process, the objects are stacked. Since a mechanical stress is applied to the steel sheet in the punching process, a residual stress exists near a cut portion after the punching process. The residual stress causes an increase in iron loss and deterioration of a magnetic flux density.

Figure 2:
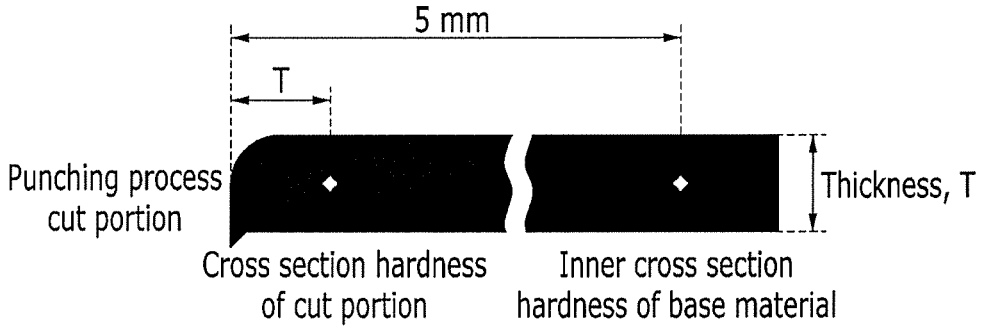
FIG. 2 is a schematic view illustrating a method of measuring a cross section hardness.

In an embodiment of the present disclosure, as a composition in the non-oriented electric steel sheet, particularly, a ratio of an Al content to a Si content, a ratio of a Mn content of a Si content, a Mo content, a P content, a Sn content and a Sb content, is limited to an optimum range, and the size of a crystal grain is limited, an optimum value of inner cross section hardness is proposed. Further, a hardening rate of a cross section hardness of a cut portion formed by the punching process to the inner cross section hardness is lowered, so that magnetic deterioration due to the punching process is low. At this time, the inner cross section hardness means an average value obtained by 10 times repeatedly measuring the Vickers hardness (HV 25 gf) of a portion except for a crystal grain boundary and an inclusion in a cross section of a point apart from the cut portion formed by the punching process by 5 mm or more under a load of 25 gf. The cross section hardness of the cut portion formed by the punching process means a cross section hardness of a point apart from the cut portion formed by the punching process by the thickness of a steel sheet. A position where the cross section is measured is illustrated in FIG. 2.

The non-oriented electric steel sheet according to the embodiment of the present disclosure includes 2.5 wt % to 3.1 wt % of Si, 0.1 wt % to 1.3 wt % of Al, 0.2 wt % to 1.5 wt % of Mn, 0.008 wt % or less of C (excluding 0 wt %), 0.005 wt % or less of S (excluding 0 wt %), 0.005 wt % or less of N (excluding 0 wt %), 0.005 wt % or less of Ti (excluding 0 wt %), 0.001 wt % to 0.07 wt % of Mo, 0.001 wt % to 0.07 wt % of P, 0.001 wt % to 0.07 wt % of Sn, and 0.001 wt % to 0.07 wt % of Sb, and the remainder includes Fe and inevitable impurities.

First, the reason why the ingredients of the non-oriented electric steel sheet are limited will be described.

Si: 2.5 wt % to 3.1 wt %

Si serves to increase specific resistance of a material to lower iron loss. When too little Si is added, the iron loss may increase. Further, when too much Si is added, a hardening rate of the cut portion formed by the punching process for the material may sharply increase. Thus, Si may be added in the above-described range.

Al: 0.1 wt % to 1.3 wt %

Al serves to increase the specific resistance of the material to lower the iron loss and to form nitrides. When too little Al is added, a small amount of nitrides is formed, and thus magnetic characteristics may deteriorate. When too much Al is added, a problem occurs in a manufacturing process such as steelmaking and continuous casting, and thus productivity may be greatly reduced. Thus, Al may be added in the above-described range.

Mn: 0.2 wt % to 1.5 wt %

Mn serves to increase the specific resistance of the material to reduce the iron loss and to form sulfides. When too little Mn is added, a small amount of MnS is finely precipitated, and thus magnetic characteristics may deteriorate. When too much Mn is added, formation of a {111}//ND texture that is adverse to the magnetic characteristics is promoted, and thus the magnetic flux density may be reduced. Thus, Mn may be added in the above-described range.

C: 0.008 wt % or less

It is preferable that since C causes magnetic aging, and is coupled to other impurity elements to form carbides to degrade the magnetic characteristics, C is limited to 0.008 wt % or less, more particularly, 0.005 wt % or less.

S: 0.005 wt % or less

It is preferable that since S, which is an element inevitably existing in the steel, forms MnS, CuS, and the like, which are fine precipitates, to degrade the magnetic characteristics, S is limited to 0.005 wt % or less, more particularly, 0.003 wt % or less.

N: 0.005 wt % or less

It is preferable that since N forms fine and long AlN precipitates inside the base material, and is coupled to other impurities to form fine nitrides to suppress growth of the crystal grain to increase the iron loss, N is limited to 0.005 wt % or less, more particularly, 0.003 wt % or less.

Ti: 0.005 wt %

It is preferable that since Ti forms carbides or nitrides to increase the iron loss, and promote development of a {111} texture that is not preferable for the magnetic characteristics, Ti is limited to 0.005 wt % or less, more particularly, 0.003 wt % or less.

Mo, P, Sn, and Sb: 0.001 wt % to 0.07 wt %

Mo, P, Sn and Sb are segregated on the surface and the crystal grain boundary of the steel sheet to suppress surface oxidation occurring during an annealing process, and suppress recrystallization of a {111}//ND orientation to improve the texture. When even one element is added less, the effect is significantly reduced, and when even one element is added more, since growth of the crystal grain is suppressed due to an increase in the amount of segregation of the crystal grain boundary, the iron loss increases, toughness of the steel sheet is lowered, and thus productivity is lowered, which is not preferable. In particular, when the sum of Mo, P, Sn, and Sb is limited to a range of 0.025 wt % to 0.15 wt %, the suppression of the surface oxidation and the improvement of the texture are maximized, so that the magnetic characteristics are significantly improved.

Other Impurities

The non-oriented electric steel sheet may include inevitably mixed impurities such as Nb, V, Mg, and Cu in addition to the above-described elements. Although small amounts of these elements are included, the inclusion formed inside the steel sheet may cause deterioration of the magnetic characteristics. Thus, Nb, V, and Mg should be managed to 0.005 wt % or less, and Cu should be managed to 0.025 wt % or less.

The non-oriented electric steel sheet according to the embodiment of the present disclosure satisfies Equations (1) and (2).

$$0.32 \leq ([Al]+[Mn])/[Si] \leq 0.5 \quad \text{[Equation 1]}$$

$$0.025 \leq [Mo]+[P]+[Sn]+[Sb] \leq 0.15 \quad \text{[Equation 2]}$$

(Here, in Equations (1) and (2), [Si], [Al], [Mn], [Mo], [P], [Sn], and [Sb] denote the contents (wt %) of Si, Al, Mn, Mo, P, Sn, and Sb.)

When a value of Equation (1) is smaller than 0.32, deterioration of the iron loss caused by the punching process may increase due to the fine precipitates. When the value of Equation (1) exceeds 0.5, since it is difficult to control impurities and hardness of the steel sheet increases, the hardening rate of the cut portion formed by the punching process increases sharply.

The average diameter of the crystal grain of the non-oriented electric steel sheet according to the embodiment of the present disclosure may range from 70 μm to 150 μm. In the above-described range, a hardening rate of the cross section hardness of the cut portion formed by the punching process is lowered as compared to the inner cross section hardness, deterioration of the magnetic characteristics caused by the punching process is lowered.

In detail, the inner cross section hardness of the non-oriented electric steel sheet according to the embodiment of the present disclosure may be not more than 210 HV. Further, the cross section hardness of the point apart from the cut portion formed by the punching process by the thickness of the steel sheet may be not more than 1.1 times of the inner cross section hardness. In more detail, the cross section hardness of the point apart from the cut portion formed by the punching process by the thickness of the steel sheet may be 1.1 times to 1 time of the inner cross section hardness.

The thickness of the non-oriented electric steel sheet according to the embodiment of the present disclosure may be 0.2 mm to 0.65 mm.

A method of manufacturing a non-oriented electric steel sheet according to an embodiment of the present disclosure includes: manufacturing a hot rolled sheet by heating slab including 2.5 wt % to 3.1 wt % of Si, 0.3 wt % to 1.3 wt % of Al, 0.2 wt % to 1.5 wt % of Mn, 0.008 wt % or less of C (excluding 0 wt %), 0.005 wt % or less of S (excluding 0 wt %), 0.005 wt % or less of N (excluding 0 wt %), 0.005 wt % or less of Ti (excluding 0 wt %), 0.001 wt % to 0.07 wt % of Mo, 0.001 wt % to 0.07 wt % of P, 0.001 wt % to 0.07 wt % of Sn, and 0.001 wt % to 0.07 wt % of Sb, in which the remainder includes Fe and inevitable impurities and the slab satisfies Equations (1) and (2), and then by hot rolling the slab; manufacturing a cold rolled sheet by cold rolling the hot rolled sheet; and recrystallization annealing the cold rolled sheet.

$$0.32 \leq ([Al]+[Mn])/[Si] \leq 0.5 \quad \text{[Equation 1]}$$

$$0.025 \leq [Mo]+[P]+[Sn]+[Sb] \leq 0.15 \quad \text{[Equation 2]}$$

(Here, in Equations (1) and (2), [Si], [Al], [Mn], [Mo], [P], [Sn], and [Sb] denote the contents (wt %) of Si, Al, Mn, Mo, P, Sn, and Sb.)

First, the hot rolled sheet is manufactured by heating the slab and then hot rolling the slab. The reason why the addition ratios of the ingredients are limited is the same as the above-described reason why the ingredients of the non-oriented electric steel sheet are limited Since the composition of the slab is not substantially changed during hot rolling, hot-rolled sheet annealing, cold rolling, recrystallization annealing, and the like, which will be described below, the composition of the slab is substantially the same as the composition of the non-oriented electric steel sheet.

The slab is inserted into a heating furnace and is heated at 1100° C. to 1200° C. When the slab is heated at a temperature that exceeds 1200° C., precipitates are redissolved and thus may be finely precipitated after the hot rolling.

The heated slab is hot rolled in a thickness of 2 mm to 2.3 mm and is manufactured into the hot rolled sheet. In the manufacturing of the hot rolled sheet, a finishing temperature may be 800° C. to 1000° C.

The hot rolled sheet, which is hot rolled, is hot-rolled-sheet-annealed in a temperature of 850° C. to 1150° C. When a hot rolled sheet annealing temperature is smaller than 850° C., a tissue is not grown or finely grown, and thus the magnetic flux density increases slightly. Further, when the annealing temperature exceeds 1150° C., the magnetic characteristics deteriorate, and rolling workability may deteriorate due to deformation of a sheet shape. Thus, a temperature range is limited to 875° C. to 1125° C. A more preferable hot rolled sheet annealing temperature ranges from 900° C. to 1100° C. The hot rolled sheet annealing is performed to increase an orientation advantageous to the magnetic characteristics as needed, and may be omitted. It is preferable that the average diameter of the crystal grain after the hot rolled sheet annealing is not less than 120 μm.

After the hot rolled sheet annealing, the hot rolled sheet is pickled and is cold-rolled to have a predetermined sheet thickness. Although the cold rolling may be differently applied depending on the thickness of the hot rolled plate, the hot rolled plate may be cold-rolled at a reduction ratio of about 70% to 95% to have a final thickness of 0.2 mm to 0.65 mm.

The cold rolled sheet, which is finally cold-rolled, is finally recrystallization-annealed such that the average diameter of the crystal grain ranges from 70 μm to 150 μm. When a final recrystallization annealing temperature is too low, recrystallization is not generated sufficiently, and when the final recrystallization annealing temperature is too high, as the crystal grain grows sharply, the magnetic flux density deteriorates and high-frequency iron loss increases. Thus, it is preferable that the recrystallization annealing is performed for 60 seconds to 150 seconds at a temperature of 850° C. to 1150° C.

The recrystallization annealed sheet is insulation-coated and is then shipped to the customer company. The insulation coating may be performed using an organic matter, an inorganic matter, or an organic-inorganic combined matter, or may be performed using other insulating coating agents. The costumer company may use this steel sheet as it is, or may use this steel sheet after stress relief annealing, as needed.

Hereinafter, the present disclosure will be described in more detail with reference to embodiments. However, the embodiments are merely intended to describe the present disclosure, and the present disclosure is not limited thereto.

Embodiment 1

A hot rolled sheet having a thickness of 2.3 mm is manufactured by heating a slab formed as represented by Table 1 below at 1100° C. and hot-rolling the slab at a finish temperature of 870° C. The hot rolled sheet is annealed for 100 seconds at 1060° C., is pickled, is cold-rolled in a thickness of 0.35 mm, and is then finally recrystallization-annealed at 990° C. for 100 seconds in the case of Specimen Nos. A1 to A7, and at 800° C., 850° C., 950° C., 1000° C., 1050° C., and 1100° C. for 90 seconds in the case of Specimen Nos. B1 to B7. ([Al]+[Mn])/[Si], [Mo]+[P]+[Sn]+[Sb], average crystal grain sizes, [P]+[Sn]+[Sb], hardness, magnetic flux densities (B1 and B50), and iron loss (W15/50) of the specimens are represented in Table 2.

A specimen is cut into eight pieces in a rolling direction, each of the cut eight pieces is cut into eight pieces in a direction that is perpendicular to the rolling direction, and thus each of the 64 pieces has a size of 305 mm×30 mm. Magnetic characteristics of each of the 64 pieces, such as a magnetic flux density and iron loss, are measured by an Epstein tester. An Epstein specimen is manufactured using two methods such as a punching process and a wire discharging process. B1 (punching), B1 (discharging), W15/50 (punching), and W15/50 (discharging) are represented as B1 and W15/50, which have measured values that are obviously different from each other depending on the processing methods. Only a value measured by the wire discharging process is represented as B50, which have measured values that are slightly different from each other depending on the processing methods.

When a difference between the magnetic characteristics of the specimens obtained by the wire discharging process and the punching process is observed, a degree of deterioration of the magnetic characteristics caused by the processes may be identified. In this case, B1 means a magnetic flux density induced in a magnetic field of 100 Nm, B50 means a magnetic flux density induced in a magnetic field of 5000 Nm, W15/50 means iron loss obtained when a magnetic flux density of 1.5 T is induced at a frequency of 50 Hz, and W10/400 means iron loss obtained when a magnetic flux density of 1.0 T is induced at a frequency of 400 Hz. A crystal grain size denotes a value calculated by an equation of (Measured area×number of crystal grains)^0.5 after a cross section of a specimen is polished and etched and an area including more than 4000 crystal grains is measured using an optical microscope. Hardness denotes an average value obtained by 10 times repeatedly measuring hardness at a point apart from a cut portion by 5 mm or more under a load of 25 gf according to a Vickers hardness measuring method after the cross section of the specimen is polished.

TABLE 1

| Specimen No. | Si (%) | Al (%) | Mn (%) | P (%) | Sn (%) | Sb (%) | Mo (%) | C (%) | S (%) | N (%) | Ti (%) |
|---|---|---|---|---|---|---|---|---|---|---|---|
| A1 | 3.00 | 0.15 | 0.50 | 0.030 | 0.030 | 0.030 | 0.010 | 0.0027 | 0.0021 | 0.0023 | 0.0036 |
| A2 | 3.00 | 0.15 | 0.90 | 0.030 | 0.030 | 0.030 | 0.010 | 0.0030 | 0.0023 | 0.0019 | 0.0034 |

TABLE 1-continued

| Specimen No. | Si (%) | Al (%) | Mn (%) | P (%) | Sn (%) | Sb (%) | Mo (%) | C (%) | S (%) | N (%) | Ti (%) |
|---|---|---|---|---|---|---|---|---|---|---|---|
| A3 | 3.00 | 0.25 | 0.50 | 0.030 | 0.030 | 0.030 | 0.010 | 0.0021 | 0.0031 | 0.0034 | 0.0011 |
| A4 | 3.00 | 0.25 | 0.80 | 0.030 | 0.030 | 0.030 | 0.010 | 0.0028 | 0.0023 | 0.0032 | 0.0012 |
| A5 | 3.00 | 0.25 | 1.40 | 0.030 | 0.030 | 0.030 | 0.010 | 0.0025 | 0.0019 | 0.0017 | 0.0024 |
| A6 | 3.00 | 0.35 | 0.80 | 0.030 | 0.030 | 0.030 | 0.010 | 0.0024 | 0.0034 | 0.0017 | 0.0021 |
| A7 | 3.00 | 0.35 | 1.30 | 0.030 | 0.030 | 0.030 | 0.010 | 0.0032 | 0.0014 | 0.0029 | 0.0023 |
| B1 | 2.75 | 0.80 | 0.35 | 0.010 | 0.050 | 0.020 | 0.020 | 0.0031 | 0.0023 | 0.0014 | 0.0019 |
| B2 | 2.75 | 0.80 | 0.35 | 0.010 | 0.050 | 0.020 | 0.020 | 0.0029 | 0.0026 | 0.0032 | 0.0014 |
| B3 | 2.75 | 0.80 | 0.35 | 0.010 | 0.050 | 0.020 | 0.020 | 0.0029 | 0.0019 | 0.0017 | 0.0032 |
| B4 | 2.75 | 0.80 | 0.35 | 0.010 | 0.050 | 0.020 | 0.020 | 0.0021 | 0.0023 | 0.0029 | 0.0021 |
| B5 | 2.75 | 0.80 | 0.35 | 0.010 | 0.050 | 0.020 | 0.020 | 0.0027 | 0.0019 | 0.0014 | 0.0017 |
| B6 | 2.75 | 0.80 | 0.35 | 0.010 | 0.050 | 0.020 | 0.020 | 0.0033 | 0.0034 | 0.0014 | 0.0029 |
| B7 | 2.75 | 0.80 | 0.35 | 0.010 | 0.050 | 0.020 | 0.020 | 0.0023 | 0.0011 | 0.0023 | 0.0014 |

TABLE 2

| Specimen No. | ([Al] + [Mn])/[Si] | [Mo] + [P] + [Sb] + [Sn] | Crystal gain (Mm) | Hardness (HV) | B1 (Punching) (T) | B1 (Discharging) (T) | B50 (T) | W15/50 (Punching) (W/kg) | W15/50 (Discharging) (W/kg) | Note |
|---|---|---|---|---|---|---|---|---|---|---|
| A1 | 0.22 | 0.1 | 130 | 203 | 1.02 | 1.17 | 1.69 | 2.23 | 2.03 | Comparative Example |
| A2 | 0.35 | 0.1 | 121 | 205 | 1.17 | 1.17 | 1.69 | 2.02 | 2.02 | Invention example |
| A3 | 0.25 | 0.1 | 129 | 204 | 1.01 | 1.18 | 1.69 | 2.21 | 2.02 | Comparative Example |
| A4 | 0.35 | 0.1 | 124 | 204 | 1.19 | 1.19 | 1.69 | 2.03 | 2.02 | Invention example |
| A5 | 0.55 | 0.1 | 108 | 217 | 1.03 | 1.18 | 1.69 | 2.20 | 2.01 | Comparative Example |
| A6 | 0.38 | 0.1 | 132 | 206 | 1.17 | 1.17 | 1.69 | 2.01 | 2.01 | Invention example |
| A7 | 0.55 | 0.1 | 105 | 219 | 1.02 | 1.19 | 1.69 | 2.24 | 2.03 | Comparative Example |
| B1 | 0.42 | 0.1 | 56 | 208 | 1.13 | 1.18 | 1.69 | 2.16 | 2.02 | Comparative Example |
| B2 | 0.42 | 0.1 | 62 | 208 | 1.12 | 1.18 | 1.69 | 2.17 | 2.04 | Comparative Example |
| B3 | 0.42 | 0.1 | 87 | 206 | 1.18 | 1.18 | 1.69 | 2.06 | 2.04 | Invention example |
| B4 | 0.42 | 0.1 | 114 | 204 | 1.18 | 1.18 | 1.69 | 2.01 | 2.01 | Invention example |
| B5 | 0.42 | 0.1 | 139 | 204 | 1.17 | 1.17 | 1.69 | 2.01 | 1.99 | Invention example |
| B6 | 0.42 | 0.1 | 162 | 203 | 1.04 | 1.17 | 1.68 | 2.19 | 2.01 | Comparative Example |
| B7 | 0.42 | 0.1 | 171 | 203 | 1.03 | 1.17 | 1.68 | 2.21 | 2.01 | Comparative Example |

All magnetic characteristics of A2, A4, A6, B3, B4, and B5, each of which ingredients and crystal grain sizes correspond to the range of the present disclosure, are excellent and the difference in magnetic characteristics according to the processing method is insignificant. On the other hand, in the case of Specimen Nos. A1, A3, A5, and A7, each of which ([Al]+[Mn])/[Si] is lower than the range of the present disclosure, B1 and W15/50 sharply deteriorate in the punching process. In the case of Specimen Nos. B1 and B2, each of which crystal grain sizes is lower than the range of the present disclosure, and Specimen Nos. B6 and B7, each of which crystal grain sizes exceeds the range of the present disclosure, B1 and W15/50 severely deteriorate in the punching process as compared to the wire discharging process.

Embodiment 2

A slab having a composition as represented in Table 3 is manufactured. In the case of C1 to C7, the contents of Mo, P, Sn, and Sn are fixed and the contents of Si, Al, and Mn are changed. In the case of D1 to D7, the contents of Si, Al, and Mn are fixed and the contents of Mo, P, Sn, and Sb are changed. A hot rolled sheet having a thickness of 2.0 mm is manufactured by heating the slab at 1130° C., and hot rolling the slab at a finish temperature of 870° C. The hot rolled sheet is annealed for 100 seconds at 1030° C., is pickled, is cold rolled in a thickness of 0.35 mm, and is then finally recrystallization annealed for 70 seconds to 130 seconds at 990° C., so that an average crystal grain size ranges from 120 μm to 130 μm.

([Al]+[Mn])/[Si], [Mo]+[P]+[Sn]+[Sb], cross section hardness of a cut portion, inner cross section hardness, a hardening rate of the cut portion, a magnetic flux density (B50), and W15/50 (punching and discharging) of each specimen are represented in Table 4.

The cross section hardness of the cut portion is an average value obtained by 10 times repeatedly measuring Vickers hardness at a point apart from the cut portion by 0.35 mm (350 μm) which is equal to the thickness of the specimen under a load of 25 gf, and the inner cross section hardness is an average value obtained by 10 times repeatedly measuring Vickers hardness at a point apart from the cut portion by 5 mm under a load of 25 gf. The hardening rate of the cut portion means a value obtained by dividing the cross section hardness of the cut portion by the inner cross section hardness.

TABLE 3

| Specimen No. | Si (%) | Al (%) | Mn (%) | P (%) | Sn (%) | Sb (%) | Mo (%) | C (%) | S (%) | N (%) | Ti (%) |
|---|---|---|---|---|---|---|---|---|---|---|---|
| C1 | 3.25 | 1.10 | 0.10 | 0.015 | 0.040 | 0.030 | 0.010 | 0.0028 | 0.0023 | 0.0019 | 0.0034 |
| C2 | 2.30 | 0.15 | 0.85 | 0.015 | 0.040 | 0.030 | 0.010 | 0.0025 | 0.0017 | 0.0034 | 0.0011 |
| C3 | 3.00 | 0.10 | 1.60 | 0.015 | 0.040 | 0.030 | 0.010 | 0.0032 | 0.0019 | 0.0023 | 0.0017 |
| C4 | 3.00 | 1.45 | 0.30 | 0.015 | 0.040 | 0.030 | 0.010 | 0.0031 | 0.0014 | 0.0012 | 0.0029 |
| C5 | 3.00 | 0.45 | 0.90 | 0.015 | 0.040 | 0.030 | 0.010 | 0.0027 | 0.0023 | 0.0024 | 0.0032 |
| C6 | 2.90 | 0.85 | 0.35 | 0.015 | 0.040 | 0.030 | 0.010 | 0.0028 | 0.0019 | 0.0034 | 0.0017 |
| C7 | 2.90 | 0.70 | 0.55 | 0.015 | 0.040 | 0.030 | 0.010 | 0.0025 | 0.0019 | 0.0014 | 0.0029 |
| D1 | 2.80 | 0.85 | 0.35 | 0.085 | 0.005 | 0.005 | 0.005 | 0.0030 | 0.0017 | 0.0021 | 0.0034 |
| D2 | 2.80 | 0.85 | 0.35 | 0.010 | 0.005 | 0.090 | 0.015 | 0.0021 | 0.0029 | 0.0032 | 0.0023 |
| D3 | 2.80 | 0.85 | 0.35 | 0.020 | 0.080 | 0.010 | 0.100 | 0.0025 | 0.0019 | 0.0021 | 0.0026 |
| D4 | 2.80 | 0.85 | 0.35 | 0.005 | 0.005 | 0.005 | 0.005 | 0.0024 | 0.0017 | 0.0017 | 0.0019 |
| D5 | 2.80 | 0.85 | 0.35 | 0.050 | 0.030 | 0.025 | 0.020 | 0.0029 | 0.0019 | 0.0029 | 0.0021 |
| D6 | 2.80 | 0.85 | 0.35 | 0.020 | 0.020 | 0.030 | 0.010 | 0.0021 | 0.0019 | 0.0017 | 0.0029 |
| D7 | 2.80 | 0.85 | 0.35 | 0.010 | 0.010 | 0.010 | 0.010 | 0.0024 | 0.0034 | 0.0029 | 0.0014 |

TABLE 4

| Specimen No. | ([Al] + [Mn])/[Si] | [Mo] + [P] + [Sn] + [Sb] | Cross section hardness of cut portion (HV) | Inner cross section hardness (HV) | Hardening rate of cut portion (%) | B50 (T) | W15/50 (punching) (W/kg) | W15/50 (discharging) (W/kg) | Note |
|---|---|---|---|---|---|---|---|---|---|
| C1 | 0.37 | 0.095 | 249 | 215 | 116 | 1.66 | 2.19 | 2.00 | Comparative Example |
| C2 | 0.43 | 0.095 | 211 | 181 | 117 | 1.69 | 2.89 | 2.71 | Comparative Example |
| C3 | 0.57 | 0.095 | 248 | 209 | 119 | 1.65 | 2.20 | 1.99 | Comparative Example |
| C4 | 0.58 | 0.095 | 243 | 212 | 115 | 1.65 | 2.21 | 1.98 | Comparative Example |
| C5 | 0.45 | 0.095 | 222 | 207 | 107 | 1.68 | 2.05 | 2.00 | Invention Example |
| C6 | 0.41 | 0.095 | 215 | 205 | 105 | 1.68 | 2.07 | 2.02 | Invention Example |
| C7 | 0.43 | 0.095 | 212 | 205 | 103 | 1.68 | 2.06 | 2.01 | Invention Example |
| D1 | 0.43 | 0.100 | 245 | 206 | 119 | 1.69 | 2.25 | 2.01 | Comparative Example |
| D2 | 0.43 | 0.120 | 240 | 204 | 118 | 1.69 | 2.22 | 2.02 | Comparative Example |
| D3 | 0.43 | 0.210 | 241 | 203 | 119 | 1.69 | 2.25 | 2.01 | Comparative Example |
| D4 | 0.43 | 0.020 | 241 | 204 | 118 | 1.69 | 2.24 | 2.00 | Comparative Example |
| D5 | 0.43 | 0.125 | 213 | 206 | 103 | 1.69 | 2.04 | 2.01 | Invention Example |
| D6 | 0.43 | 0.080 | 215 | 205 | 105 | 1.69 | 2.03 | 2.00 | Invention Example |
| D7 | 0.43 | 0.040 | 215 | 204 | 105 | 1.69 | 2.05 | 2.01 | Invention Example |

As represented in Table 4, in the case of Specimen Nos. C5, C6, C7, D5, D6, and D7 corresponding to the range of the present disclosure, it can be identified that since the hardening rate of the cut portion is not more than 110% and deterioration of the magnetic characteristics caused by the punching process is small, W15/50 (punching) does not greatly deteriorate as compared to W15/50 (discharging). On the other hand, in the case of Specimen Nos. C1, C2, C3, and C4, each of which the content of Si, Al, or Mn deviates from the range of the present disclosure, the hardening rate of the cut portion is not less than 110%, which exceeds the range of the present disclosure. Accordingly, W15/50 (punching) more greatly deteriorates as compared to W15/50 (discharging). Further, in the case of Specimen Nos. D1, D2, D3, and D4, each of which the content of Mo, P, Sn, or Sb and the content of [Mo]+[P]+[Sn]+[Sb] deviate from the range of the present disclosure, since the hardening rate of the cut portion is not less than 110%, which exceeds the range of the present disclosure, W15/50 (punching) greatly deteriorates as compared to W15/50 (discharging).

The present disclosure is not limited to the embodiments, and may be implemented in various other forms. It may be understood by those skilled in the art to which the present disclosure pertains that the present disclosure may be implemented in other detailed forms without changing the technical spirit or the essential feature of the present disclosure. Therefore, it should be understood that the above-described embodiments are not restrictive but illustrative in all aspects.

The invention claimed is:

1. A non-oriented electric steel sheet comprising:

2.5 wt % to 3.1 wt % of Si, 0.1 wt % to 1.3 wt % of Al, 0.2 wt % to 1.5 wt % of Mn, 0.008 wt % or less of C excluding 0 wt %, 0.005 wt % or less of S excluding 0 wt %, 0.005 wt % or less of N excluding 0 wt %, 0.005 wt % or less of Ti excluding 0 wt %, 0.01 wt % to 0.02 wt % of Mo, 0.001 wt % to 0.07 wt % of P, 0.001 wt % to 0.07 wt % of Sn, and 0.001 wt % to 0.07 wt % of Sb, wherein a remainder includes Fe and inevitable impurities;

wherein an average crystal grain diameter of the non-oriented electric steel sheet is 70 μm to 150 μm, wherein the non-oriented electric steel sheet satisfies [Equation 1] and [Equation 2], $$0.32 \leq ([Al]+[Mn])/[Si] \leq 0.5 \quad \text{[Equation 1]:}$$

$$0.025 \leq [Mo]+[P]+[Sn]+[Sb] \leq 0.15 \quad \text{[Equation 2]:}$$

wherein [Si], [Al], [Mn], [Mo], [P], [Sn], and [Sb] denote the contents in wt % of Si, Al, Mn, Mo, P, Sn, and Sb, respectively, wherein W15/50 (punching) of the non-oriented electric steel sheet is 2.01 to 2.07 W/kg;

wherein inner cross section hardness of the non-oriented electric steel sheet is not more than 210 HV, and wherein the inner cross section hardness means an average value obtained by 10 times repeatedly measuring Vickers hardness (HV 25 gf) of a portion except for a crystal grain boundary and an inclusion in a cross section of a point apart from a cut portion formed by a punching process by 5 mm or more under a load of 25 gf.

2. The non-oriented electric steel sheet of claim 1, wherein a thickness of the non-oriented electric steel sheet is 0.2 mm to 0.65 mm.

3. The non-oriented electric steel sheet of claim 1, wherein cross section hardness of a point apart from the cut portion formed by the punching process by a thickness of the non-oriented electric steel sheet is not more than 1.1 times of the inner cross section hardness.

4. A method of manufacturing the non-oriented electric steel sheet of claim 1, the method comprising:

manufacturing a hot rolled sheet by heating a slab and then by hot rolling the slab;

manufacturing a cold rolled sheet by cold rolling the hot rolled sheet; and recrystallization annealing the cold rolled sheet for 60 seconds to 150 seconds at 875° C. to 1125° C., wherein the slab includes 2.5 wt % to 3.1 wt % of Si, 0.1 wt % to 1.3 wt % of Al, 0.2 wt to 1.5 wt % of Mn, 0.008 wt % or less of C excluding 0 wt %, 0.005 wt % or less of S excluding 0 wt %, 0.005 wt % or less of N excluding 0 wt %, 0.005 wt % or less of Ti excluding 0 wt %, 0.01 wt % to 0.02 wt % of Mo, 0.001 wt % to 0.07 wt % of P, 0.001 wt % to 0.07 wt % of Sn, and 0.001 wt % to 0.07 wt % of Sb, wherein a remainder includes Fe and inevitable impurities;

wherein the slab satisfies [Equation 1] and [Equation 2], $$0.32 \leq ([Al]+[Mn])/[Si] \leq 0.5 \quad \text{[Equation 1]:}$$

$$0.025 \leq [Mo]+[P]+[Sn]+[Sb] \leq 0.15 \quad \text{[Equation 2]:}$$

wherein [Si], [Al], [Mn], [Mo], [P], [Sn], and [Sb] denote the contents in wt % of Si, Al, Mn, Mo, P, Sn, and Sb respectively.

5. The method of claim 4, wherein in the manufacturing of the hot rolled sheet, the heating of the slab is performed at 1100° C. to 1200° C.

6. The method of claim 4, wherein in the manufacturing of the hot rolled sheet, the hot rolling is performed at a finish temperature of 800° C. to 1000° C.

7. The method of claim 4, further comprising: annealing the hot rolled sheet at 850° C. to 1150° C.

8. The method of claim 4, wherein in the manufacturing of the cold rolled sheet, the cold rolled sheet is cold rolled in a thickness of 0.20 mm to 0.65 mm.

9. The method of claim 4, wherein cross section hardness of a point apart from the cut portion formed by the punching process by a thickness of the non-oriented electric steel sheet is not more than 1.1 times of the inner cross section hardness.

* * * * *